United States Patent [19]

dePolo

[11] 4,198,916

[45] Apr. 22, 1980

[54] PROCESS AND APPARATUS FOR MAKING GARMENTS FORMED OF HELICALLY JOINED PIECES

[76] Inventor: Harry R. dePolo, 480 Park Ave., New York, N.Y. 10022

[21] Appl. No.: 921,181

[22] Filed: Jul. 3, 1978

Related U.S. Application Data

[63] Continuation-in-part of Ser. No. 770,034, Feb. 18, 1977, Pat. No. 4,097,933.

[51] Int. Cl.[2] ..... D05B 1/00

[52] U.S. Cl. ..... 112/63; 112/121.15; 112/262.2

[58] Field of Search ..... 112/63, 262, 121.15, 112/262.1, 262.2, 262.3

[56] References Cited

U.S. PATENT DOCUMENTS

| | | | |
|---|---|---|---|
| 3,052,197 | 9/1962 | Judelson | 112/63 |
| 3,759,198 | 9/1973 | Pisani | 112/63 |

*Primary Examiner*—Doris L. Troutman

*Attorney, Agent, or Firm*—Robert E. Burns; Emmanuel J. Lobato; Bruce L. Adams

[57] ABSTRACT

Strips of material fed from a supply roll are propelled helically around a cylindrical form with edges of adjacent convolutions of the material contiguous with one another and the contiguous edges of the material are joined together to form a tubular structure. Either before or after formation into a tubular structure the material is cut in predetermined manner into garment lengths and to provide armholes or other openings as desired. In one embodiment means is provided for joining adjacent edges of two or more narrower strips to form a wider composite strip which is then wound helically and edges of adjacent convolutions are joined to form a tubular structure. The narrower strips may be formed from wider material by continuous splitting means which is adjustable to provide different widths. An attachment for a sewing machine has inclined rollers engageable with strips of material being stitched to guide them so that their edges are contiguous as they are being stitched to an underlying tape.

25 Claims, 24 Drawing Figures

FIG. 9
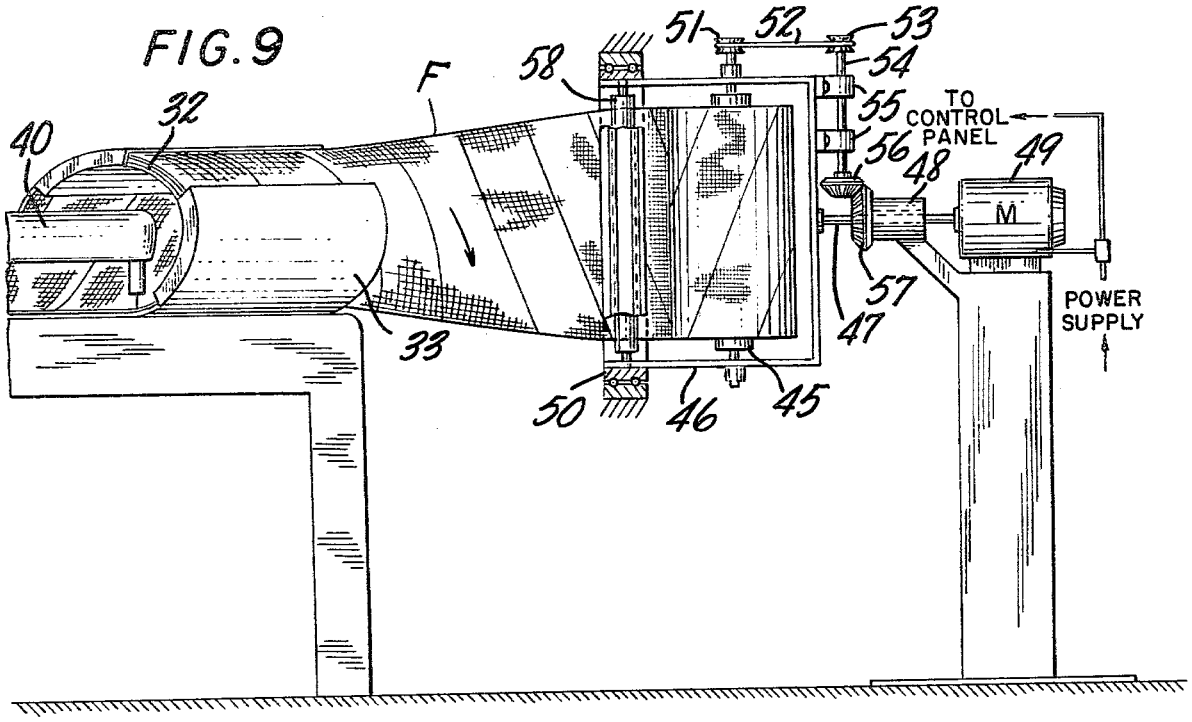
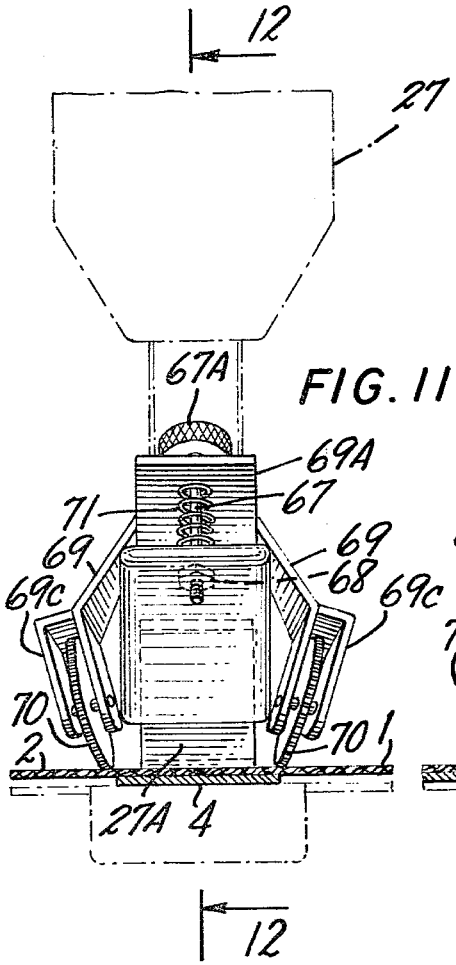
FIG. 11
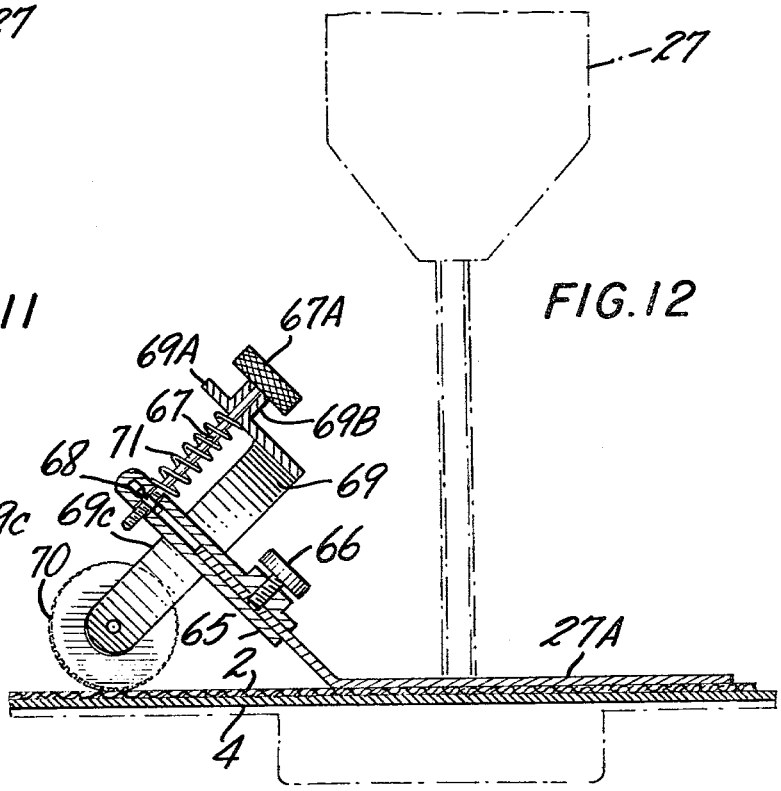
FIG. 12

FIG. 16
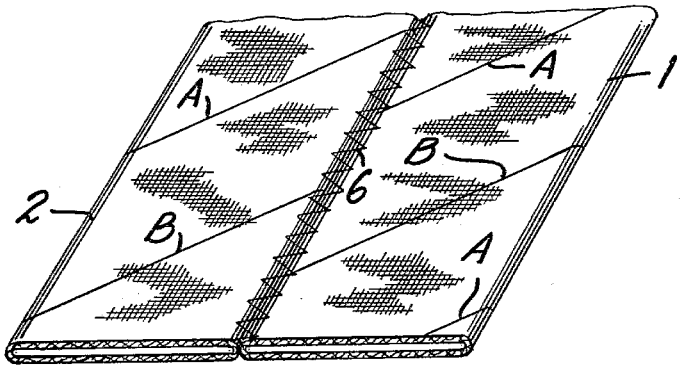
FIG. 17
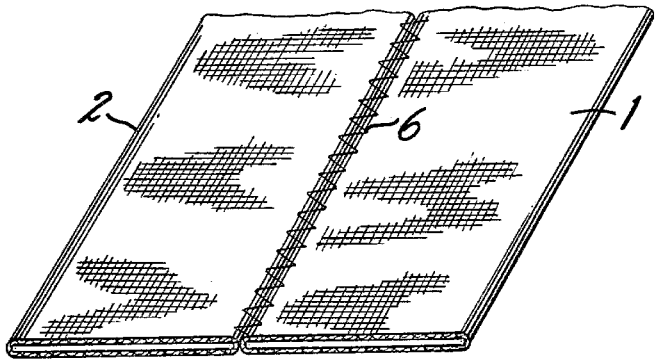
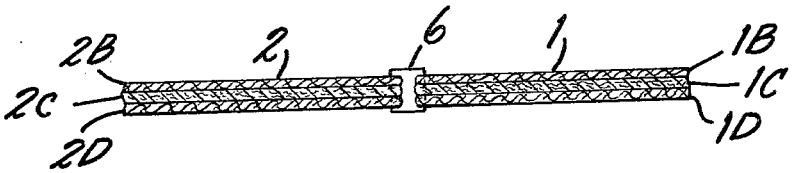
FIG. 18
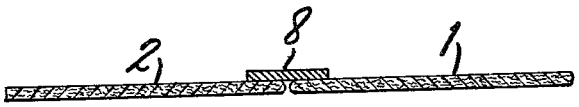
FIG. 19

FIG. 20
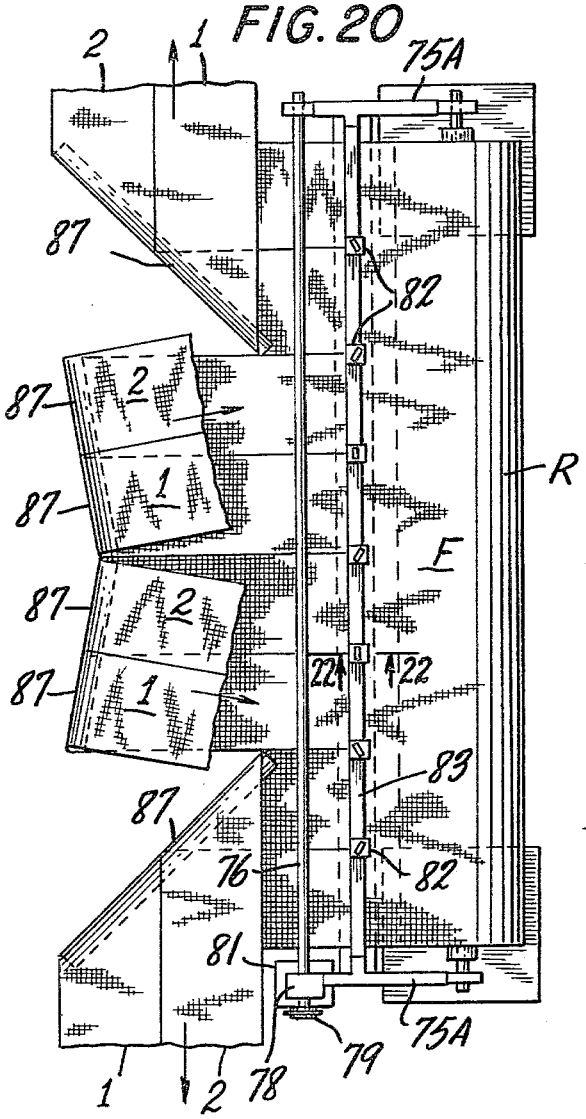
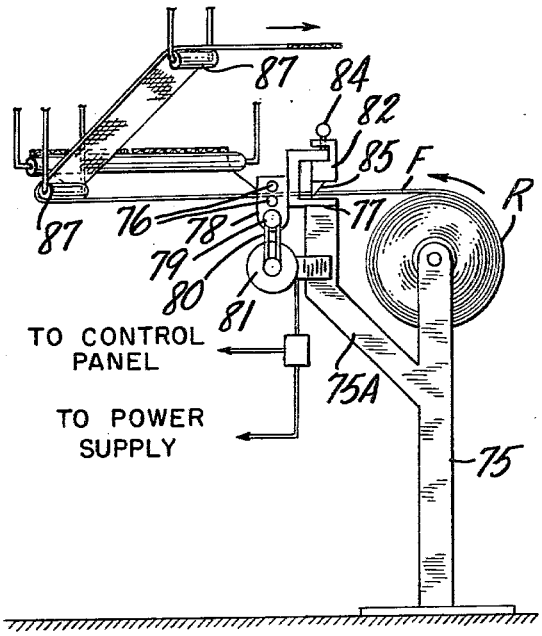
FIG. 21
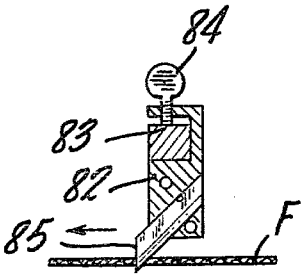
FIG. 22
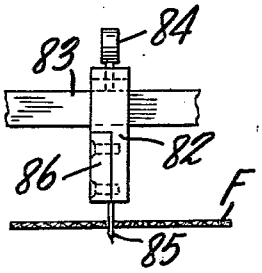
FIG. 23

PROCESS AND APPARATUS FOR MAKING GARMENTS FORMED OF HELICALLY JOINED PIECES

REFERENCE TO PRIOR APPLICATION

This application is a continuation-in-part of my application Ser. No. 770,034 filed Feb. 18, 1977 now U.S. Pat. No. 4,097,933.

FIELD OF INVENTION

The present invention relates to the manufacture of garments including dress-type garments and pants-type garments. The term "dress-type garment" is used broadly to include dresses, slips, blouses, coats, jackets, nightgowns, hostess coats, skirts, shirts and other sheath-type garments for covering or partially covering the torso and in some cases the legs of a wearer. The term "pants-type garment" is used broadly to include pants, slacks, jeans, culottes, shorts and similar garments for covering the lower portion of the torso and individually covering or partially covering the legs of a wearer.

BACKGROUND OF INVENTION

Dress-type garments and pants-type garments have heretofore been made by using a pattern to cut pieces of various sizes and shapes from fabric material and then sewing the pieces together. Frequently it is necessary to use pleats, darts, shirring or gathering to obtain a garment of the desired shape. By reason of the time, skill and labor involved, it has become more and more expensive to manufacture clothing. Even by mass production methods, the labor involved in cutting and assembling garments made by conventional methods has increased the cost of ready-made clothes.

SUMMARY OF THE INVENTION

It is an object of the present invention to overcome the disadvantages of the prior art by providing novel construction processes and apparatus which greatly simplify the work involved in making garments. Instead of being formed of numerous pieces of fabric cut according to pattern then sewn together, garments in accordance with the present invention are formed of one or more long strips of material wound in a helical manner about a cylindrical form, adjacent edges of successive convolutions being joined to form a tubular structure. Either before or after being helically wound into tubular form, the material is cut in predetermined manner into garment lengths and to provide any armholes or other openings required in the garments. The process of construction in accordance with the present invention thus simplifies not only the cutting of the fabric but also its assembly into garments. In its simplest form a garment made by the process of the present invention (apart from any sleeves or trimming) consists of a single long strip of material which is wound helically and has contiguous edges of adjacent convolutions of the helix joined by a single continuous helical seam. If two or more strips are used they can first be joined edge-to-edge by continuous seams whereupon the composite strip thus formed is wound in a helix and edges of adjacent convolutions of the composite strip are thereupon joined by a single continuous seam.

The legs of pants-type garments and sleeves of dress-type garments (when sleeves are desired) are made in like manner by winding one or more strips of material helically and joining the contiguous edges of adjacent convolutions of the helix by a continuous seam. In the case of pants-type garments upper end portions of the strips forming the respective legs are shaped so that when joined together by a central seam they form the top part of the garment.

In addition to simplifying the construction of garments, the present invention makes possible the production of garments of novel style and attractive appearance. The helical construction in itself imparts a distinctive appearance to the garment. In contrast with conventional garments in which all or most of the seams run either horizontally or vertically, the seams of garments made in accordance with the present invention run helically. Moreover, if the garment is made of two or more long strips of material, the strips can be of different fabrics or different patterns or textures thereby highlighting the effect created by the helical construction.

Material used in the process of the present invention whether woven, knitted or non-woven can readily be produced in strips of suitable width. If wider material is to be used, means is provided for splitting the material lengthwise into strips of suitable width.

While adjacent edges of strips of material may be joined directly to one another, for example by stitching, an advantageous method of joining the edges is to stitch them to an underlying tape which may be either elastic or essentially non-elastic. To assure that the edges of the material are correctly positioned relative to the tape and to one another, guide means attached to the presser foot of a sewing machine comprises inclined wheels or rollers which engage and guide the fabric as it is being stitched.

BRIEF DESCRIPTION OF DRAWINGS

The nature, objects and advantages of the invention will be more fully understood from the following description of preferred embodiments illustrated by way of example in the accompanying drawings in which:

FIG. 9 is a side elevation partially in section of the apparatus illustrated in FIG. 8;

FIG. 11 is an enlarged front view of an attachment for a sewing machine comprised in the apparatus of FIG. 6;

FIG. 12 is a vertical cross section taken approximately on the line 12—12 in FIG. 11;

FIG. 16 is a schematic perspective view illustrating the use of flattened tubes as strips of material in carrying out the process of the present invention, each of the tubes being formed of a helically wound strip;

FIG. 17 is a schematic perspective view showing the use of flattened seamless tubes as strips of material in carrying out the process of the present invention;

FIG. 18 is a schematic cross sectional view illustrating the use of strips each composed of superposed layers in carrying out the process of the present invention;

FIG. 19 is a schematic cross section illustrating the joining of adjacent edges of material by adhesive tape in carrying out the process of the invention;

FIG. 20 is a schematic plan illustrating apparatus for splitting wider material into strips used in carrying out the process of the invention;

FIG. 21 is a schematic end view of the apparatus shown in FIG. 20;

FIG. 22 is a partial sectional view taken approximately on the line 22—22 in FIG. 20; and FIG. 23 is an elevation of the portion of apparatus shown in FIG. 22.

DESCRIPTION OF PREFERRED EMBODIMENTS

Figure 1:
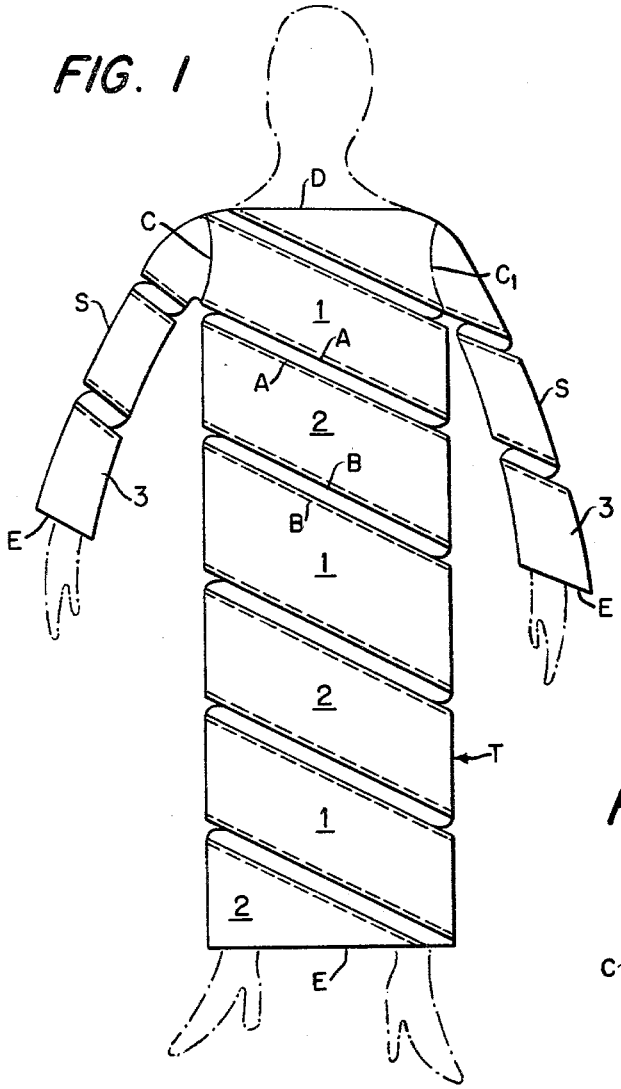
FIG. 1 is a schematic view of a dress-type garment made in accordance with the present invention.
Figure 2:
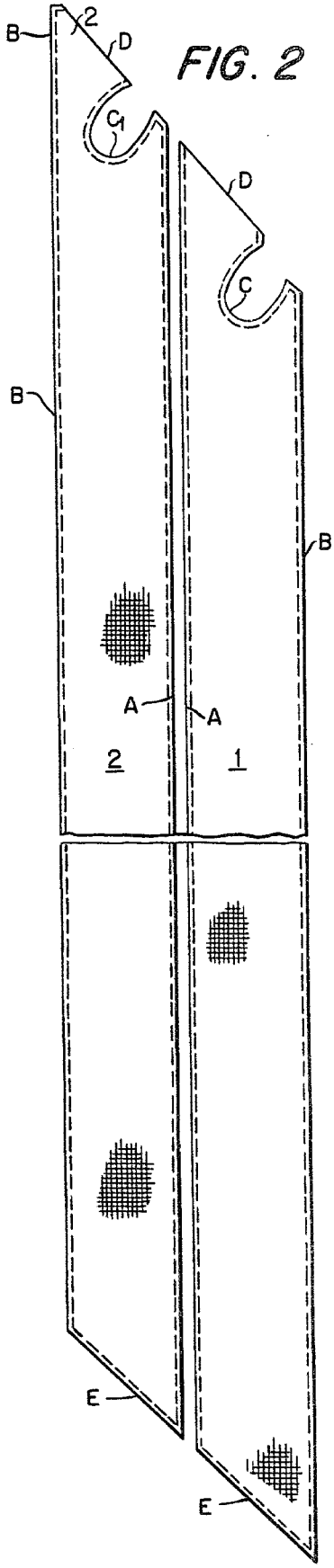
FIG. 2 shows the strips of material from which the body portion of the garment of FIG. 1 is made.
Figure 3:
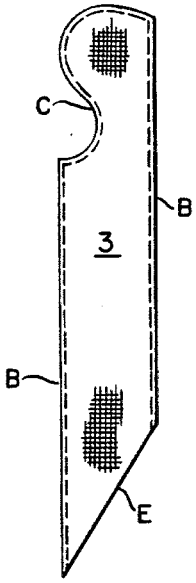
FIG. 3 shows a strip of material from which one of the sleeves of the garment of FIG. 1 is made.

In FIG. 1 there is shown schematically a dress made in accordance with the present invention while FIGS. 2 and 3 show strips of material from which the dress is made. The dress is shown as having a square neckline D and two sleeves S. The body portion of the dress is made of material F shown in FIG. 2 as two strips of material 1 and 2. Each of the strips is approximately 8 inches wide. The dotted lines along the edges of the strips represent seam allowances. The length of the strips depends on the size and desired length of the dress. By way of example, each of the strips may be approximately 11 feet long. The strips are of woven, knitted or unwoven material suitable for the desired garment. Knitted material is especially suitable for some applications by reason of its having a certain amount of elasticity. Near their upper ends, the strips 1 and 2 are provided respectively with cutouts C and $C_1$ which provide armholes. Inclined edges D at the upper ends of the strips form the neck opening of the dress. Inclined edges E at the lower ends of the strips form the hemline of the dress. It will be understood that edges D and E are suitably finished for example by hemming or rolling.

As will be described more fully below, the dress is assembled in accordance with the process of the present invention by first joining adjacent edges A of the two strips 1 and 2 in a continuous straight seam. The composite strip thus formed is then wound helically as illustrated schematically in FIG. 1 and the edge B of strip 1 is joined to the edge B of strip 2 so as to form a tubular structure. The edge B of strip 1 is of the same length as the edge B of strip 2 so that the edges of successive convolutions of the composite strip are joined together without shirring, gathering or puckering. In order to illustrate the construction more clearly, the edges of strips 1 and 2 are shown spaced in FIG. 1. However, it will be understood that edges A are joined by a continuous seam before the composite strip is wound into helical form and that the edges B of adjacent convolutions are likewise joined by a continuous seam.

The sleeves S of the dress shown in FIG. 1 are, like the body portion, formed of helically wound strips. The strip 3 which forms one of the sleeves is shown in FIG. 3, the other strip being a mirror image of the one shown. To form the sleeves the strips are wound helically and successive convolutions of the strip are joined by a continuous seam. The sleeves thus formed are set in armholes provided by the cutouts C and $C_1$.

Figure 4:
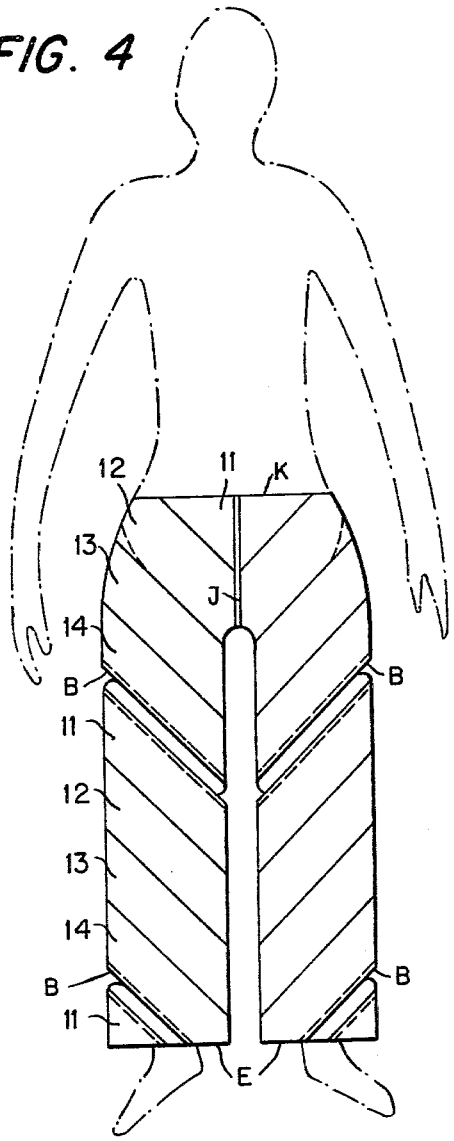
FIG. 4 is a schematic illustration of a pants-type garment made in accordance with the present invention.
Figure 5A:
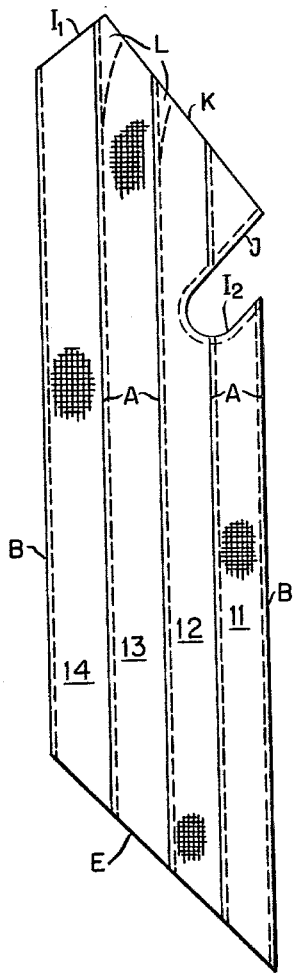
FIGS. 5A and 5B show strips of material from which the garment of FIG. 4 is made.
Figure 5B:
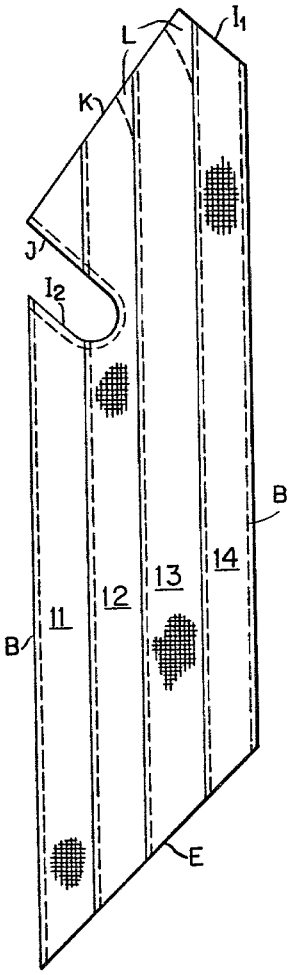

In FIG. 4 there is shown schematically a trouser-type garment shown as a pair of pants made in accordance with the process of the present invention. The strips of material of which the pants are made is shown in FIGS. 5A and 5B. The material for the right leg (shown at the left in FIG. 4) and the corresponding upper part of the pants is shown in FIG. 5A while the material for the left leg and corresponding upper part is shown in FIG. 5B. It will be seen that the two legs and corresponding upper portions are identical with one another except that one is the mirror image of the other.

Each of the legs and corresponding upper portion of the pants is shown as being formed of four strips of material 11–14. The strips are disposed side-by-side and contiguous edges A of adjacent strips are joined by seams to form a composite strip 11–14. The lower edge of the composite strip is cut at an angle to provide an inclined edge E which forms the bottom edge of the pants leg. At its upper end the composite strip has an upwardly inclined edge $I_1$ which extends across strip 14 and a portion of strip 13. A downwardly inclined edge K extends across the balance of strip 13 and across strips 12 and 11. In the upper part of the composite strip just below the inclined end edge K there is provided an inclined cutout having an upper edge J and a lower edge $I_2$.

After the strips 11–14 are assembled as shown in FIGS. 5A and 5B, the composite strip which is to form each leg is wound into the form of a helix and contiguous edges B of successive convolutions of the helix are joined by a continuous seam so as to form the corresponding leg of the pants.

In order to join the two legs of the pants, the upper edge J of one leg is joined with the edge J of the other leg so as to form a front central seam J as shown in FIG. 4. The edge $I_2$ of one leg is joined with the corresponding edge $I_2$ of the other leg to form a portion of a central back seam while edges $I_1$ of the two legs are joined with one another to form a continuation of the back central seam. The edges K of the two legs form the upper edge or waist of the pants. It will be understood that the upper edge can be provided with a waistband or otherwise finished as desired. In order to shape the waist, upper portions of the seams joining the contiguous edges of strips 12, 13 and 14 can be tapered as illustrated in dotted lines at L. It will be understood that an opening with a suitable zipper or other closure can be provided either between edges J or at the side or back of the pants as de ired.

While each of the pants legs is shown as being made of four strips of equal width, it will be understood that strips of different widths may be used and also that the number of strips can be varied so long as the width between the side edges B of the composite strip is correct for the type and size of pants to be made. Moreover, it will be understood that other pants-type garments such as slacks, jeans, culottes and shorts may be made in like manner. The material used is selected so as to be appropriate for the type of garment being made. When each of the pants legs is made of a plurality of strips of material as illustrated, many different styling effects can be obtained by selection of the material used for the respective strips. Thus the several strips can, if desired, be made of different pattern, color or texture.

While only one dress-type and one pants-type garment have been illustrated in the drawings, it will be understood that the process is equally applicable to many other styles of garments, for example as illustrated in said patent no. the disclosure of which is herein incorporated by reference.

Figure 7:
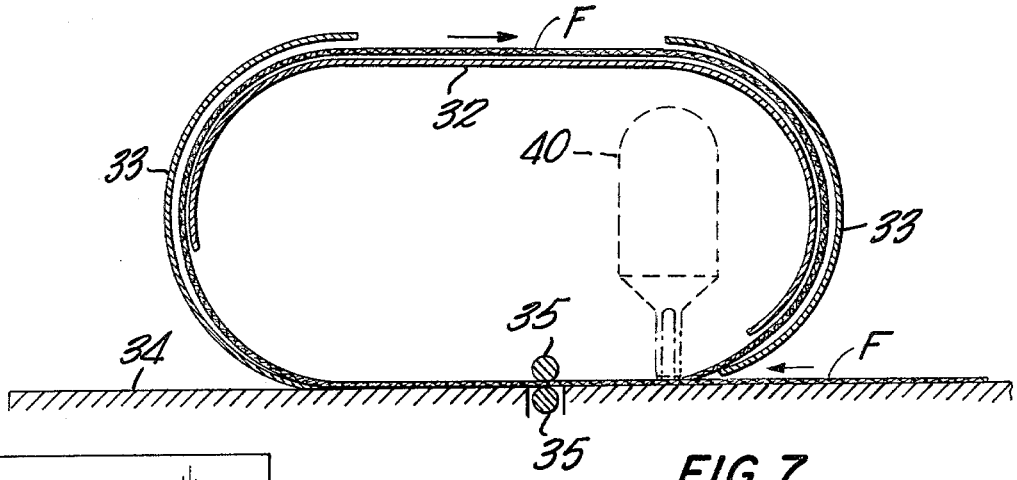
FIG. 7 is a schematic cross section taken approximately on the line 7—7 in FIG. 6.
Figure 6:
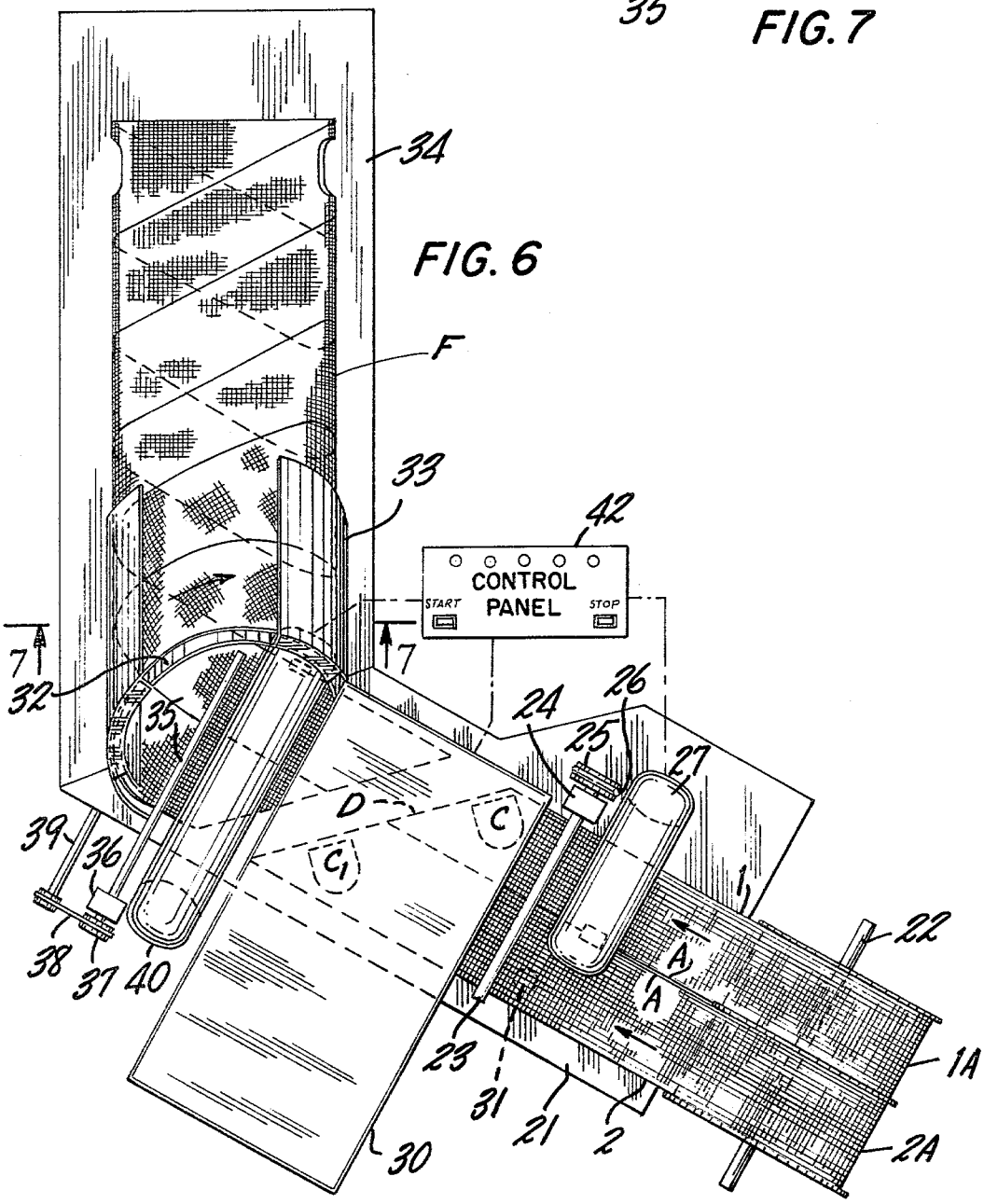
FIG. 6 is a schematic plan of apparatus for making garments in accordance with the present invention.

Apparatus for carrying out the process of the present invention on a commercial scale is illustrated schematically by way of example in FIGS. 6 and 7. The apparatus is shown as comprising a work surface 21 onto which two strips of material 1 and 2 are fed side-by-side from rolls or reels 1A and 2A respectively which are rotatably supported by a shaft 22. The material is drawn onto the work surface by upper and lower elongated puller rolls 23 disposed respectively above and below the material so as to grip the material between them. It will be understood that the lower roll is hidden by upper roll and hence does not show in FIG. 6. The puller rolls are driven in opposite directions through a gear box 24, the input of which comprises a pulley 25 driven by a belt 26 from a suitable motor or drive shaft (not show).

As the strips of material 1 and 2 are drawn over the work surface 21 by the puller rolls 23, adjacent edges A of the strips are joined to one another so as to form a composite strip. The means for joining the edges of the strips 1 and 2 is shown schematically in FIG. 6 as a sewing machine 27 which unites the edges by a continuous seam. The sewing machine 27 may be of a type that joins the edges of the strips with one another in overlapping relation or of a type that joins the two edges in abutting relation. As both types of sewing machines are well known, the sewing machine has been shown only schematically.

The puller rolls 23 forward the composite strip of material to a programmed automatic cutting machine 30. The cutting machine 30 is programmed so as to cut the fabric along an inclined edge D and also to provide armhole cutouts C and $C_1$. The cutting may be effected in any appropriate manner, for example by means of a knife, laser beam or high pressure water jet. The cutting machine 30 is controlled by a sensing device 31 which measures the fabric as it is propelled by the puller rolls 23 and controls the cutting machine so as to cut the material to suitable length for the garments that are being produced. Alternatively the control may be effected by sensing the rotation of the puller rolls 23. As automatic programmed cutting machines are well known, such machine is only schematically shown in the drawings.

From the cutting machine 30 the composite strip is advanced to means for coiling the composite strip into a helix and joining contiguous edges of adjacent convolutions of the helix so as to form a tubular structure. Such means is illustrated schematically in the drawings as comprising a cylindrical form of oval cross section composed of an inner mandrel 32 and outer mandrels 33 (FIG. 7). The material is propelled over a work surface 34 by upper and lower rollers 35 which are disposed respectively above and below the material and are driven in opposite directions through a gear box 36 the input of which comprises a pulley 37 driven by a belt 38 from a pulley on a drive shaft 39. The central longitudinal axis of the cylindrical form comprising mandrels 32 and 33 is disposed at an angle to the rollers 35 so that as the material is advanced by the rollers it is caused to coil in helical configuration inside the outer mandrels 33 and over the inner mandrel 32 with adjacent edges of successive convolutions of the material contiguous to one another. As the composite strip is thus formed into a helix, contiguous edges of successive convolutions of the helix are joined so as to produce a tubular structure. Means for joining the edges is shown schematically as a sewing machine 40 which, like the sewing machine 27, may be of any suitable type. The contiguous edges of the fabric are thereby stitched together for example in overlapping or abutting relationship. As in the case of rollers 23, the rollers 35 are located shortly downstream of the sewing machine and are coordinated with the usual feed mechanism of the sewing machine so as to keep the material smooth and flat throughout its width.

At the downstream end of the form comprising mandrels 32 and 33, the material is discharged onto a surface 34 from which it can be removed either manually or by suitable conveying equipment. It will be recognized that the article thus produced comprises the body portion of a dress-type garment requiring only the insertion of sleeves (if sleeves are desired) and the finishing of the neckline and hemline to be a finished garment.

For different size garments different mandrels are used in order to produce a helically wound tubular structure of suitable diameter. Moreover, the cutting machine 30 is suitably programmed to provide the proper garment length and armhole or other cutouts as required for the particular garments to be produced. The same or similar apparatus can also be used for producing sleeves and trousers legs by selecting the proper size of mandrel.

All components of the apparatus including rollers 23, sewing machine 27, cutting machine 30, rollers 35 and sewing machine 40 are controlled by a central control panel 42 so that the operation of all components is coordinated. The control panel is provided with suitable start and stop buttons and includes suitable protective circuitry.

Figure 8:
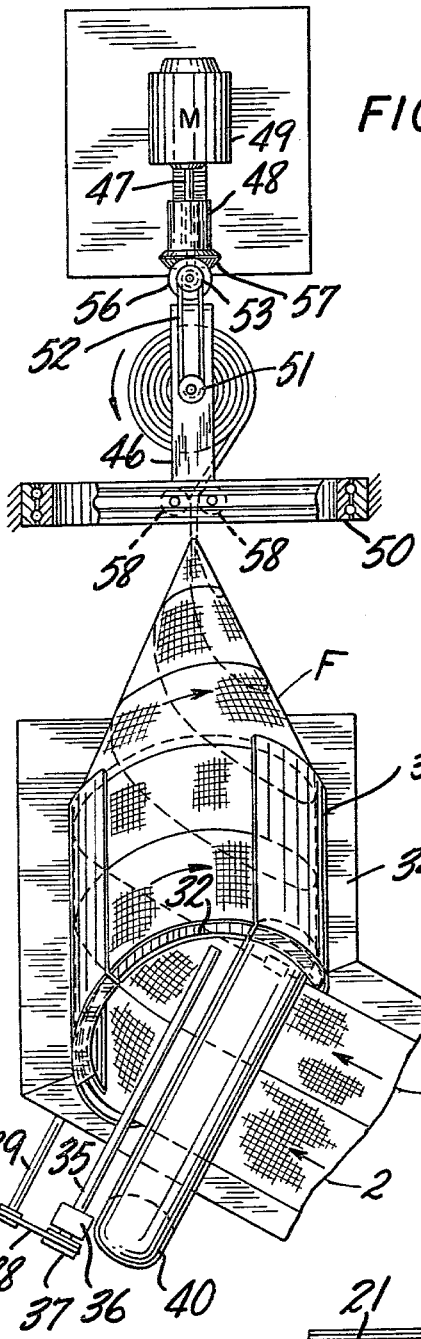
FIG. 8 is a schematic plan view partially in section illustrating a modification of the apparatus shown in FIG. 6.

Instead of being cut into garment length before being wound into helical form, the material can be formed into a continuous helically wound tubular structure which is later cut into garment length and provided with such other cutouts as are desired for the garments being produced. When a continuous helically wound tubular structure is to be produced, the cutting machine 30 is rendered inoperative and means is provided for taking-up the helically wound tube as it comes off the form comprising mandrels 32 and 33. Suitable take-up mechanism is illustrated schematically in FIGS. 8 and 9 as comprising a reel 45 rotatably supported by a frame 46 which is fixed on the end of a shaft 47 rotatably supported by a bearing 48 and driven by a motor 49. The axis of the shaft 47 is perpendicular to the axis of the reel 45. At its outboard end the frame 46 is supported by the inner race of a large diameter antifriction bearing 50, the outer race of which is stationary and suitably supported as indicated schematically in the drawings. As the frame 46 rotates about the axis of the shaft 47 and coaxial bearing 50, the reel 45 is driven so as to take-up the material as it comes off the discharge ends of mandrels 32 and 33. Such drive is shown as being provided by a pulley 51 which is coupled coaxially with the reel 45 and is driven by a belt 52 from a pulley 53 on a shaft 54 which is rotatably supported on the frame 46 by bearings 55. The shaft 54 is driven by a bevel gear 56 which is fixed on the inner end of the shaft 54 and meshes with a stationary bevel gear 57 mounted on the structure of bearing 48. It will be seen that as the frame 46 is rotated by the motor 49, the gear 56 runs around the gear 57 and its rotation is transmitted through belt 52 to the reel 45 so as to wind-up the material on the reel. The material is guided to the reel by opposed rollers 58 which are rotatably supported at their ends inside the ring forming the inner race of the bearing 50. The motor 49 includes suitable speed reducing means and is connected to the central control panel 42 so as to be coordinated with the means for forming the material into a helically wound tube. The frame 46 is thereby rotated at the same speed at which the material revolves around the axis of the mandrels 32,33 as it is coiled into helical form. The gear ratio of gears 56 and 57 and the diameters of pulleys 51 and 53 are selected so as to drive the reel 45 at proper speed to take up the material when the reel is starting empty. As the material is wound-up on the reel and the effective diameter of the reel is thereby increased, the speed of rotation of the reel must be reduced. This is achieved by suitable frictional slippage in the drive of the reel. Such slippage may for example be provided by slipping of the belt 52 or by providing a suitable friction slip-coupling either between the shaft 54 and pulley 53 or between the pulley 51 and the reel. The reel is mounted in the frame 46 in a removable manner so that when the desired amount of material has been wound-up on a reel it can be removed and replaced by an empty reel.

The continuous length of helically wound material thus produced can subsequently be made into garments by cutting it into garment length and providing such cutouts that may be required for example for armholes. This may be achieved with the apparatus shown in FIG. 6 by placing a reel of the helically wound material on shaft 22 and feeding the material to the cutting machine 30 by means of the puller rolls 23, the sewing machine 27 being rendered inoperative. The cutting machine is programmed and controlled so as to cut the material into garment length and provide such cutouts as may be desired. Alternatively other appropriate cutting equipment may be used.

In like manner, helically wound tubular material of appropriate diameter can be cut to suitable lengths for sleeves and for the legs and upper portions of pants-type garments.

Figure 10:
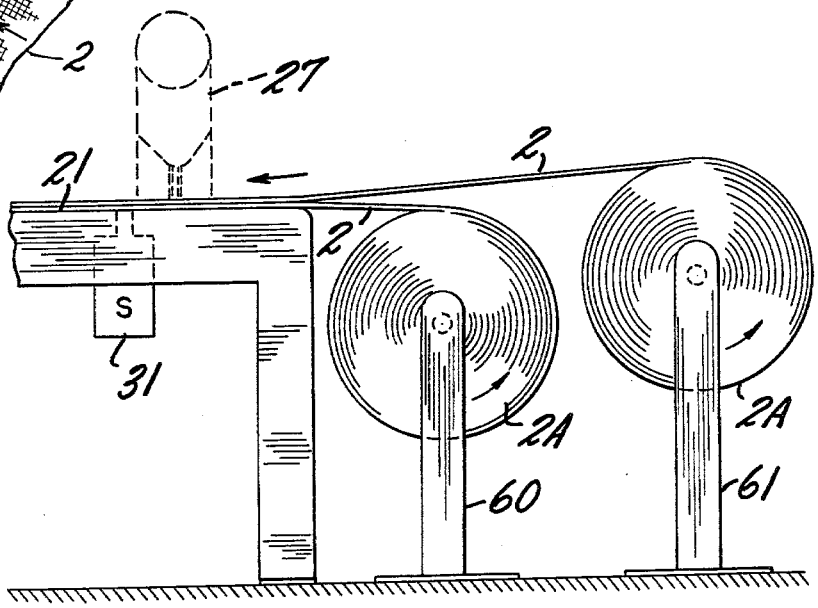
FIG. 10 is a schematic side elevation illustrating a modification of the apparatus of FIG. 6.

In some instances it is desirable to use two or more layers of material in order to produce multiple-ply garments. For example reversible garments may be produced by using one material for one side and a different material for the other side. Another possibility is to sandwich a layer of thermal material between inner and outer layers so as to provide heat insulating garments. In FIG. 10 there is shown schematically a modification of the apparatus for producing multi-ply garments. As illustrated in FIG. 10, the apparatus comprises means for feeding two superposed strips of material 2 onto the working surface 21 from two reels of material 2A supported respectively by stands 60 and 61. In like manner two superposed strips 1 are fed onto the work surface 21 in side-by-side relation to the strips 2 in the manner illustrated in FIG. 6. A sewing machine 27 joins the strips 1 with the strips 2 and simultaneously joins the superposed strips with one another. The composite strip thus produced is processed as described above with reference to FIGS. 6 and 7 to form individual garment blanks or as described with reference to FIGS. 8 and 9 to form a continuous length of helically wound material. Instead of feeding two superposed layers as illustrated in FIG. 10, three or more layers can be fed in like manner to provide the number of plies desired.

Instead of joining the strips 1 and 2 by stitching them directly to one another as described above with reference to FIG. 6, the strips may be joined by stitching them to an underlying tape 4 as illustrated in FIGS. 11 and 12. In this event the tape 4 is fed onto the working surface 21 from a suitable roll or reel (not shown) so as to lie beneath the abutting edges of the strips of material 1 and 2. A double needle sewing machine 27 stitches edge portions of both of strips 1 and 2 to the underlying tape 4. In order to assure that the adjacent edges of strips 1 and 2 abut each other, means is provided for guiding the strips as they approach the sewing machine 27. The guiding means is illustrated in FIGS. 11 and 12 as an attachment which is mounted on the presser foot 27A of the sewing machine. The attachment comprises a clip portion 65 which is shown in the form of a flattened tube with one closed end which slips onto an up-turned end portion of the presser foot and is secured by a thumb screw 66. A shaft 67 having a threaded lower end portion extends through aligned holes in upper and lower portions of the clip 65 near its outer end and is screwed through a nut 68 which is non-rotatably held between upper and lower portions of the clip. A generally U-shaped bracket 69 has a forwardly extending portion 69*a* provided with a hole through which the shaft 67 extends. Moreover, the shaft extends through an aligned hole in an upwardly extending boss 69B on the forwardly extending portion of the bracket so as to guide the bracket and restrain it from excessive tilting movement. A knurled head 67A on the shaft 67 engages the boss 69B of the bracket 69. A coil compression spring 71 surrounds the shaft 67 and acts between the clip 65 and the forwardly extending portion of the bracket 69 so as to hold the bracket up against the head 67A of the shaft. It will be seen that with this arrangement the shaft 67 can be rotated by means of the head 67A so as to adjust the position of the bracket 69 in the direction of the shaft.

A small wheel 70 is rotatably mounted on the lower end of each of the legs of the U-shaped bracked 69. Each of the legs of the bracket 69 is provided with a fork portion 69C in order to support both ends of the axle of wheel 70. As seen in FIG. 11 the axles of the wheels 70 are inclined so that the wheels converge downwardly toward one another. Moreover, the wheels are toed-out slightly as shown in a somewhat exagerated manner in FIG. 11 so that as they roll on the fabric they tend to bring the edges of the fabric toward one another. The peripheral edges of the wheels 70 are prefereably provided with small teeth so as to improve their engagement with the fabric. Different thicknesses of fabric or multiple-ply materials can be accommodated by adjustment provided by rotation of the shaft 67 by means of knurled knob 67*a*. When the attachment is not needed it is readily removed from the presser foot of the sewing machine by loosening the screw 66.

Figure 13:
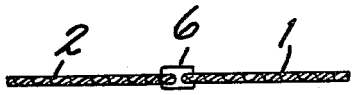
FIG. 13 is a schematic cross section illustrating one method of joining contiguous edges of fabric in carrying out the process of the present invention.
Figure 14:
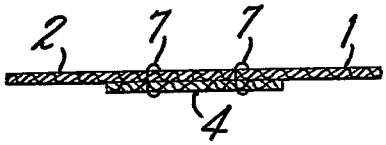
FIGS. 14 and 15 are schematic cross section showing other modes of joining the fabric.
Figure 15:
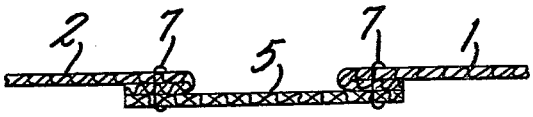

FIGS. 13–15 illustrate schematically different ways in which adjacent edges of two strips of material can be joined in carrying out the process of the present invention. In FIG. 13 the adjacent edges of strips of material 1 and 2 are shown abutting one another and joined by zig-zag stitching 6. In FIG. 14 adjacent edge portions of strips 1 and 2 are abutting and the strips are joined by means of an underlying tape or band 4 to which both strips are connected by stitching 7. The modes of joining the strips as illustrated in FIGS. 13 and 14 are especially suitable when the strips have selvage edges as in the case of narrow fabrics. FIG. 15 illustrates a somewhat different construction in which edge portions of strips 1 and 2 are turned under and stitched to a connecting tape or band 5 which may be of elastic or essentially non-elastic material.

FIGS. 16 and 17 illustrate a process in which strips 1 and 2 are in the form of flattened tubular material. In FIG. 16 the tubes forming strips 1 and 2 are helically wound tubes produced as described in conjunction with FIGS. 8 and 9. The helically wound tubes are of such diameter that when flattened they provide strips of suitable width. In FIG. 17 the strips 1 and 2 are formed by flattening seamless tubular material as produced for example on a circular knitting machine. This material is especially advantageous in that it can be produced inexpensively, has finished edges formed by folds of the tube and has any desired degree of elasticity.. In FIGS. 16 and 17 abutting edges of the strips formed of flattened tubular material are joined by zig-zag stitching 6.

In FIG. 18 the strip 1 is formed of superposed layers 1B, 1C and 1D while the strip 2 is composed of superposed layers 2B, 2C and 2D as described above in connection with FIG. 10. Adjacent edges of the strips are joined by zig-zag stitching 6 which joins strips 1 and 2 and also joins the superposed layers of each strip with one another.

FIG. 19 illustrates another mode of joining adjacent edges or strips 1 and 2 namely by an adhesive tape 8 comprising a tape provided with a coating of suitable adhesive which may for example be thermo-plastic or pressure sensitive. When using this form of attachment the sewing machine 27 illustrated in FIG. 6 is replaced by means for applying the adhesive tape 8 to join the edges of strips 1 and 2. Likewise the sewing machine 40 in FIGS. 6 and 7 may be replaced by means for joining contiguous edges of adjacent convolutions of the helically wound material by means of adhesive tape. This mode of joining is particularly advantageous when using non-woven material. Because of the economies made possible with the process of the present invention, it is feasible to use non-woven material in making garments which are disposable so as to avoid the need of cleaning or laundering. For example disposable garments can be made for use in laboratories, hospitals, workshops and many other applications.

In carrying out the process of the present invention it has been found that the strip which is wound into helical form to form the body portion of the garment should preferably have a width of about 15 to 24 inches. Such strip may, of course, be composed of narrower strips such as two 8 inch strips as illustrated in FIGS. 1 and 2 or four 4 inch strips as illustrated in FIGS. 4, 5A and 5B. Narrow fabrics are available in these various widths and have the advantage of having selvage edges. Moreover, when the strips are formed as flattened tubes as illustrated in FIGS. 16 and 17, any desired width can be obtained and here again the strips have finished edges. However, if it is desired to use wider material, this can readily be split into strips of the desired width by the apparatus illustrated in FIGS. 20 to 23. This apparatus is shown as comprising adjustably spaced bolt holders 75 for holding a bolt R of fabric F. Puller rollers 76 draw the fabric from the roll R across a cutter base 77 supported by arms 75A of the supports 75. The puller rollers 76 are located above and below the fabric F and are driven in opposite directions through a gear box 78, the input of which comprises a pulley 79 driven by a belt 80 from a motor 81. A plurality of blade holders 82 are carried by bar 83 which extends lengthwise above the cutter base 77. The blade holders 82 are slidable along the bar 83 and are secured in desired positions by thumb screws 84 so as to be positioned to cut strips of the desired width. Each of the blade holders 82 holds a blade 85 which is secured by a removable cover 86 held for example by screws. The blades 85 are positioned as seen in FIGS. 22 and 23 so as to cut the fabric as it is drawn over the cutter base 77 by the puller rollers 76. The wide fabric is thereby split into a plurality of strips 1 and 2 of the desired width. These strips are taken off over rollers 87 by which the strips are directed either to reeling equipment or to apparatus such as that shown in FIG. 6. For example when the strips are taken off in four pairs as shown by way of example in FIG. 20, each pair can be fed to garment making apparatus such as that shown in FIG. 6. Thus the splitting apparatus 40 could supply four garment making machines. When strips of material are supplied directly from the apparatus shown in FIGS. 20–23 to apparatus such as that shown in FIG. 6, the motor 6 is connected with the control panel 42 (FIG. 6) so that the operation of the apparatus shown in FIGS. 20–23 is coordinated with that shown in FIG. 6.

While preferred forms of apparatus have been shown by way of example in the drawings for carrying out the process in accordance with the present invention, it will be understood that such apparatus is susceptible of variations and modifications and that the invention is thus in no way limited to the illustrated embodiments.

What is claimed is:

1. A process of making garments formed of helically joined pieces, which comprises feeding from a supply roll a continuous strip of garment material, propelling said strip helically around a cylindrical form with edges of adjacent convolutions of said material contiguous with one another while joining said contiguous edges of adjacent convolutions of said material to form a tubular structure, and cutting said material in predetermined manner into garment lengths and to provide any openings required in said garments.

2. A process according to claim 1, in which said cutting is performed prior to said joining.

3. A process according to claim 1, in which said cutting is performed subsequent to said joining.

4. A process according to claim 1, in which said strip of garment material comprises a flattened seamless tube.

5. A process according to claim 1, in which said strip of material comprises a flattened tube formed of a strip of material wound in helical form with contiguous edges of adjacent convolutions of said material joined together.

6. A process according to claim 1, in which said strip comprises a plurality of superposed layers of material.

7. A process according to claim 6, in which said layers of material comprise an upper layer, a lower layer and an intermediate layer of material different from the material of said upper layer.

8. A process according to claim 1, in which said edges of adjacent convolutions of said material are joined by adhesive means.

9. A process of making garments formed of helically joined pieces which comprises feeding from supply rolls a plurality of continuous strips of garment material in side-by-side relation with adjacent edges contiguous, joining contiguous edges of said strips to form a wider composite strip, propelling said composite strip helically around a cylindrical form with edges of adjacent convolutions of said composite strip contiguous with one another while joining said contiguous edges to form a tubular structure, and cutting said material in predetermined manner into garment lengths and to provide any openings required in said garments.

10. A process according to claim 9, which includes forming said plurality of strips of material by longitudinally splitting wider material.

11. A process according to claim 9, in which said cutting is performed after the joining of said strips to form said composite strip and before propelling said composite strip helically about said form.

12. A process according to claim 9, in which said cutting is performed subsequent to formation of said tubular structure.

13. Apparatus for making garments formed of helically joined pieces, which comprises a cylindrical form, means for feeding to said form a strip of garment material from a supply roll containing a continuous length of said material, means for propelling said strip of material helically around said form with edges adjacent convolutions of said material contiguous with one another, means for joining said contiguous edges of adjacent convolutions of said material to form a tubular structure, and means for cutting said material in predetermined manner into garment lengths and to provide any openings required in said garments.

14. Apparatus according to claim 13, in which said cutting means is located ahead of said joining means.

15. Apparatus according to claim 13, further comprising means for taking-up said tubular construction as it is discharged from said form.

16. Apparatus according to claim 15, in which said take-up means comprises a reel, means for driving said reel to take-up said tubular structure and means mounting said reel for rotation about an axis perpendicular to the axis of said reel.

17. Apparatus for making garments formed of helically joined pieces, which comprises means for feeding from supply rolls a plurality of continuous strips of garment material in side-by-side relation with adjacent edges contiguous, first means for joining said contiguous edges of said strips to form a wider composite strip, a cylindrical form, means for propelling said composite strip helically around said cylindrical form with edges of adjacent convolutions contiguous with one another, second means for joining said contiguous edges of said composite strip to form a tubular structure, and means for cutting said material in predetermined manner into garment lengths and to provide any openings required in said garments.

18. Apparatus according to claim 17, in which said cutting means is located between said first and second joining means.

19. Apparatus according to claim 17, in which said first joining means comprises sewing means for joining said contiguous edges of said plurality of strips by stitching.

20. Apparatus according to claim 17, in which said feeding means comprises means for feeding a tape beneath adjacent edges of said strips and said first joining means comprises sewing means for stitching said adjacent edges of said strips to said tape.

21. Apparatus according to claim 20, in which said sewing means comprises a presser foot engaging said material and guide wheels carried by said presser foot and engaging adjacent strips of material to guide them as they are being stitched to said tape.

22. In a sewing machine the combination of a sewing head having two needles spaced laterally from one another, a presser foot mounted below said sewing head in position to engage material being stitched and means for guiding said material, said guiding means comprising mounting means, means for affixing said mounting means to said presser foot, an inverted U-shaped bracket adjustably carried by said mounting means with downwardly extending legs at opposite sides of said presser foot and guide wheels rotatably mounted on said legs of said bracket in position to engage the material being stitched.

23. A combination according to claim 22, in which said wheels are rotatably mounted on inclined axles with said wheels inclined downwardly toward one another.

24. Apparatus according to claim 17, further comprising means upstream of said first joining means for splitting a wider piece of material to form said plurality of strips.

25. Apparatus according to claim 24, in which said splitting means comprises means providing an elongated cutting zone, means for continuously feeding material from a supply roll to and through said cutting zone, a support bar extending lengthwise of said cutting zone, a plurality of cutting instrumentalities mounted on said bar for adjustment to different positions along said bar and engaging said material to split it as it passes through said cutting zone to form a plurality of strips of material and means for taking-up said strips of material as they are formed.

* * * * *